US006059551A

United States Patent [19]

Amano et al.

[11] Patent Number: 6,059,551

[45] Date of Patent: May 9, 2000

[54] OIL INJECTED SCREW COMPRESSOR WITH THRUST FORCE REDUCING MEANS

[75] Inventors: Yasushi Amano; Norio Kawaguchi; Takao Ohama, all of Takasago, Japan

[73] Assignee: Kabushiki Kaisha Kobe Seiko Sho, Kobe, Japan

[21] Appl. No.: 08/954,232

[22] Filed: Oct. 20, 1997

[30] Foreign Application Priority Data

Oct. 25, 1996 [JP] Japan ..... 8-283677

[51] Int. Cl.[7] ..... F04C 18/16; F04C 29/02

[52] U.S. Cl. ..... 418/84; 418/203; 418/DIG. 1

[58] Field of Search ..... 418/203, 97, DIG. 1, 418/84, 87

[56] References Cited

U.S. PATENT DOCUMENTS

| | | | |
|---|---|---|---|
| 3,932,073 | 1/1976 | Schibbye et al. | 418/203 |
| 4,185,949 | 1/1980 | Lundberg | 418/203 |
| 4,462,769 | 7/1984 | Schibbye et al. | 418/1 |
| 4,465,446 | 8/1984 | Nemit, Jr. et al. | 418/201.1 |
| 4,915,514 | 4/1990 | Soderlund | 418/203 |
| 4,964,790 | 10/1990 | Scott | 418/203 |
| 5,207,568 | 5/1993 | Szymaszek | 418/203 |
| 5,246,357 | 9/1993 | Sjoholm et al. | 418/97 |
| 5,411,388 | 5/1995 | Soderlund | 418/203 |
| 5,678,987 | 10/1997 | Timuska | 418/97 |

FOREIGN PATENT DOCUMENTS

| | | |
|---|---|---|
| 0 376 373 | 7/1990 | European Pat. Off. . |
| 14 28 244 | 2/1969 | Germany . |
| 210 565 | 6/1984 | Germany . |
| WO 91/12432 | 8/1991 | WIPO . |
| WO 95/10708 | 4/1995 | WIPO . |
| WO 95/23290 | 8/1995 | WIPO . |

*Primary Examiner*—John J. Vrablik

*Attorney, Agent, or Firm*—Oblon, Spivak, McClelland, Maier & Neustadt, P.C.

[57] ABSTRACT

A screw compressor capable of increasing a pressure receiving area of a balance piston, employing a thrust bearing having a large load capacity, and preventing an occurrence of a reverse thrust load state when started. The rotor shaft extending beyond both sides of screw rotors 11, 12 is rotatably supported by radial bearings 13, 14. An input shaft 15 serves as a rotor shaft on the suction side. A rotor shaft on the discharge side is rotatably supported by a thrust bearing 16 at a position farther away from the screw rotors 11, 12 than the radial bearing 14. A balance piston 17 is mounted on the rotor shaft at a position farther away from the screw rotors 11, 12 than the thrust bearing 16. A partitioning wall 31 is provided between the thurst bearing 16 and the balance piston 17. An equalizing flowpassage for directing oil from an oil reservoir of an oil separating and recovering unit provided in the discharge flowpassage without pressurizing it, is provided in a space adjacent the partitioning wall 31 of the balance piston 17.

2 Claims, 7 Drawing Sheets

OIL INJECTED SCREW COMPRESSOR WITH THRUST FORCE REDUCING MEANS

BACKGROUND OF THE INVENTION

1. Field of the Invention

The present invention relates to an oil injected screw compressor adapted to reduce a thrust force acting on a screw rotor.

2. Description of the Related Art

A screw compressor adapted to reduce a thrust force acting on a screw rotor shown in FIGS. 6 to 10 has been heretofore known.

The oil injected screw compressor shown in FIGS. 6 and 7 comprises a compressor body 3 connected to a suction flowpassage 1 at a first end and a discharge flowpassage 2 at a second end oil supply flowpassage 7 connects an oil reservoir 5 which is provided below an oil separating and recovering unit 4 provided in the discharge flowpassage 2, lubricating points such as a bearing, a shaft seal part or the like within the compressor body 3 via an oil pump 6. More specifically, within the compressor body 3, a pair of external and internal screw rotors 11, 12 meshed with each other are rotatably supported by radial bearings 13, 14 on a rotor shaft extending through the compresser body 3, as shown in FIG. 7. In FIG. 7, the left side is the suction side, and the right side is the discharge side. The arrows on the left side indicate an inlet of suction gas, and an arrow on the right side indicates an outlet of discharge gas.

In case of the compressor shown in FIG. 7, a rotor shaft extending to the left side of the external rotor 12 comprises an input shaft 15 which receives a rotational driving force by a motor (not shown). A thrust bearing 16 is provided on the rotor shaft, on the right side of the radial bearing 14 provided on the discharge side of the external rotor 12, and a balance piston 17, for reducing a thrust force acting on the screw rotors 11, 12, i.e, a thrust force acting in a direction from the discharge side toward the suction side is provided on the rotor shaft between the radial bearing 14 and the thrust bearing 16,.

As shown in FIG. 6, the suction flowpassage 1 is at suction pressure $P_s$, the discharge flowpassage is at discharge pressure $P_d$, the primary side of the oil pump 6 of the oil supply flowpassage 7 is at discharge pressure $P_d$, and therefore the secondary side of the oil pump 6 is at oil pressure $P_d+\alpha(\alpha>0)$. The relationship between these pressures is $P_s<Pd<Pd+\alpha$.

Oil having oil pressure $P_d+\alpha$ leaving oil pump 6 is fed to the bearing and shaft seal (not shown) within the compressor body 3 and acts on the surface on the radial bearing 14 side of the balance piston 17 to reduce the thrust force.

The oil injected screw compressor shown in FIG. 8 basically comprises the same construction as the compressor body 3 shown in FIGS. 6 and 7 which is coupled in tandem by a coupling 21 except that the oil injected screw compressor shown in FIGS. 6 and 7 is of the single stage whereas that shown in FIG. 8 is of the two-stage. Accordingly, parts of the oil injected screw compressor shown in FIG. 8 corresponding to those of the oil injected screw compressor shown in FIGS. 6 and 7 are indicated by the same reference numerals. Particularly, the description is omitted for parts with a subscript a attached thereto, since they correspond to the same-numbered parts in FIGS. 6 and 7.

Compressed gas discharged from the first-stage compressor body 3 flows from a portion marked by ⁎ to a portion marked by *, is compressed by the second-stage compressor 3*a* and is discharged to the discharge flowpassage 2. Also in this compressor, the oil pressure $P_d+\alpha$ a acts on the surface on the radial bearings 14, 14*a* of the balance pistons 17, 17*a*.

A screw compressor shown in FIG. 9 is substantially the same as the compressor shown in FIG. 7 except that, the input shaft 15 is arranged on the discharge side, and the balance piston 17 is arranged on the suction side opposite to the input shaft 15. Parts corresponding to each other are indicated by the same reference numbers, the description of which is omitted.

In FIG. 9, pressure is allowed to act on the left surface of the balance piston 17, that is, the surface opposite to the radial bearing 13 to reduce the thrust force.

The oil injected screw compressor shown in FIG. 10 basically comprises the same construction as the compressor body 3 shown in FIG. 9 except that the oil injected screw compressor shown in FIG. 9 is of the single stage whereas that shown in FIG. 10 is of the two-stage. Accordingly, parts of the oil injected screw compressor shown in FIG. 10 which corresponds those of the oil injected screw compressor shown in FIG. 9, are indicated by the same reference numerals. Particularly, a subscript a is attached to the parts in FIG. 10 which correspond to the same parts in FIG. 9, a description of which is omitted.

Similarly to the above, compressed gas discharged from the first-stage compressor body 3 flows from a portion marked by ⁎ to a portion marked by *, is compressed by the second-stage compressor 3*a* and is discharged to the discharge flowpassage 2. Also in this compressor, the oil pressure acts on the surface opposite to the radial bearings 13, 13*a* of the balance pistons 17, 17*a*.

In this case, a partitioning wall 31 which cuts off pressure is provided between the balance piston 17 and the coupling 21.

In the case of the screw compressor shown in FIGS. 6, 7 described above, the balance piston 17 is arranged adjacent to the radial bearing 14, and the surface on the side of the radial bearing 14 of the balance piston 17 comprises a pressure receiving surface. It has been found that, it is difficult to secure a sufficient surface area for receiving pressure on the balance piston 17. It has also been found that although, the oil pressure $P_d+\alpha$ always acts on the radial bearings 13, 14 during operation immediately after the start of the compressor or during no-load operation, the load of the compressor is small and therefore the thrust force is small. In such a case, a force greater than that acting on the screw rotors 11, 12, acts on the balance piston 17 to assume a so-called reverse thrust load state so as to press the screw rotors 11, 12 toward the discharge side. A clearance between the end of the screw rotors 11, 12 on the discharge side and a rotor chamber housing them is made as narrow as possible in order to enhance the performance of the compressor. There is a problem in that as the bearing wears, the screw rotors 11, 12 may come in contact with the wall of the rotor chamber, resulting in failure.

In the case of the compressor shown in FIG. 8 in which the same construction as that of the compressor body 3 shown in FIGS. 6, 7 is coupled in tandem, a discharge port of the first-stage compressor body 3 can be communicated with a suction port of the second-stage compressor body 3*a* by a flowpassage formed within the casing without depending on an external pipe. However, the aforementioned problem may occur also in this case.

In the case of the compressor shown in FIG. 9, since a diameter of the thrust bearing portion on the discharge side is determined depending on a diameter of the input shaft 15 and a diameter of the radial bearing 14, the load capacity of the thrust bearing 16 having a large inside diameter should be employed. As a result, there is a problem in that the load capacity of the thrust bearing 16 cannot be increased.

Further, in the case of the compressor shown in FIG. 10 in which the same construction as that of the compressor body 3 shown in FIG. 9 is coupled in tandem, it is impossible to form a flowpassage within the casing from a discharge port of the first-stage compressor body 3 to a suction port of the second-stage compressor body 3*a* and therefore an external pipe should be provided. This complicates the construction of the compressor and makes the apparatus bulky. In addition, vibrations and noises caused by a pulsation of the discharge gas from the first-stage compressor body 3 increase.

The present invention solves the problems as noted above with respect to prior art. An object of the present invention is to provide a screw compressor which increases a pressure receiving area of a balance piston, employs a thrust bearing having a large load capacity, removes an occurrence of a reverse thrust load state, has a simple and compact construction, and inhibits vibration and noise.

SUMMARY OF THE INVENTION

In order to solve the aforementioned problem, according to the present invention, there is provided an oil injected compressor, comprising a screw rotor, a rotor shaft extending, from both sides of the screw rotor radial bearings for rotatably supporting said rotor shaft on both the suction side and the discharge side, a thrust bearing for rotatably supporting said rotor shaft on a side of the discharge side radial bearing opposite the screw rotor, a balance piston mounted on said rotor shaft on a side of the thrust bearing opposite the screw rotor partitioning provided between said thrust bearing and said balance piston for cutting off pressure a discharge flowpassage of compressed gas, an oil separating and recovering unit provided in said discharge flowpassage, and an equalizing flowpassage for guiding oil from an oil reservoir of said oil separating and recovering unit to a side of said partitioning wall, the oil not being pressurized thereat.

According to the present invention, there is further provided the oil injected compressor described above, further comprising a first pressure detector provided in said discharge flowpassage, a second pressure detector provided in said equalizing flowpassage, a pressure regulating valve provided in said equalizing flowpassage, and a pressure regulating meter for adjusting an opening degree of said pressure regulating valve so that a difference between a pressure value detected by said first pressure detector and a pressure value detected by said second pressure detector is a value within a predetermined range.

DETAILED DESCRIPTION OF PREFERRED EMBODIMENTS

Embodiments of the present invention will be described hereinafter with reference to the accompanying drawings.

Figure 1:
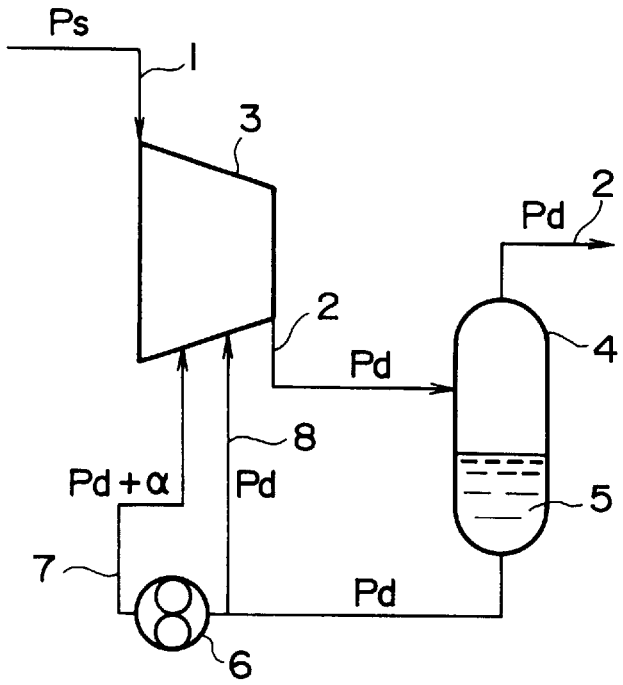
FIG. 1 shows the entire constitution of a screw compressor according to a first aspect of the embodiment of a first invention.
Figure 2:
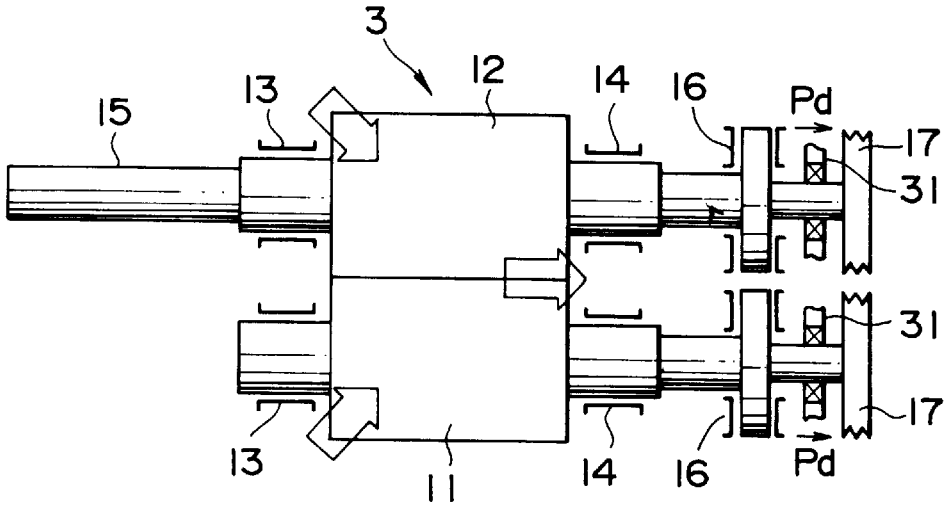
FIG. 2 shows the internal construction of the compressor shown in FIG. 1.
Figure 3:
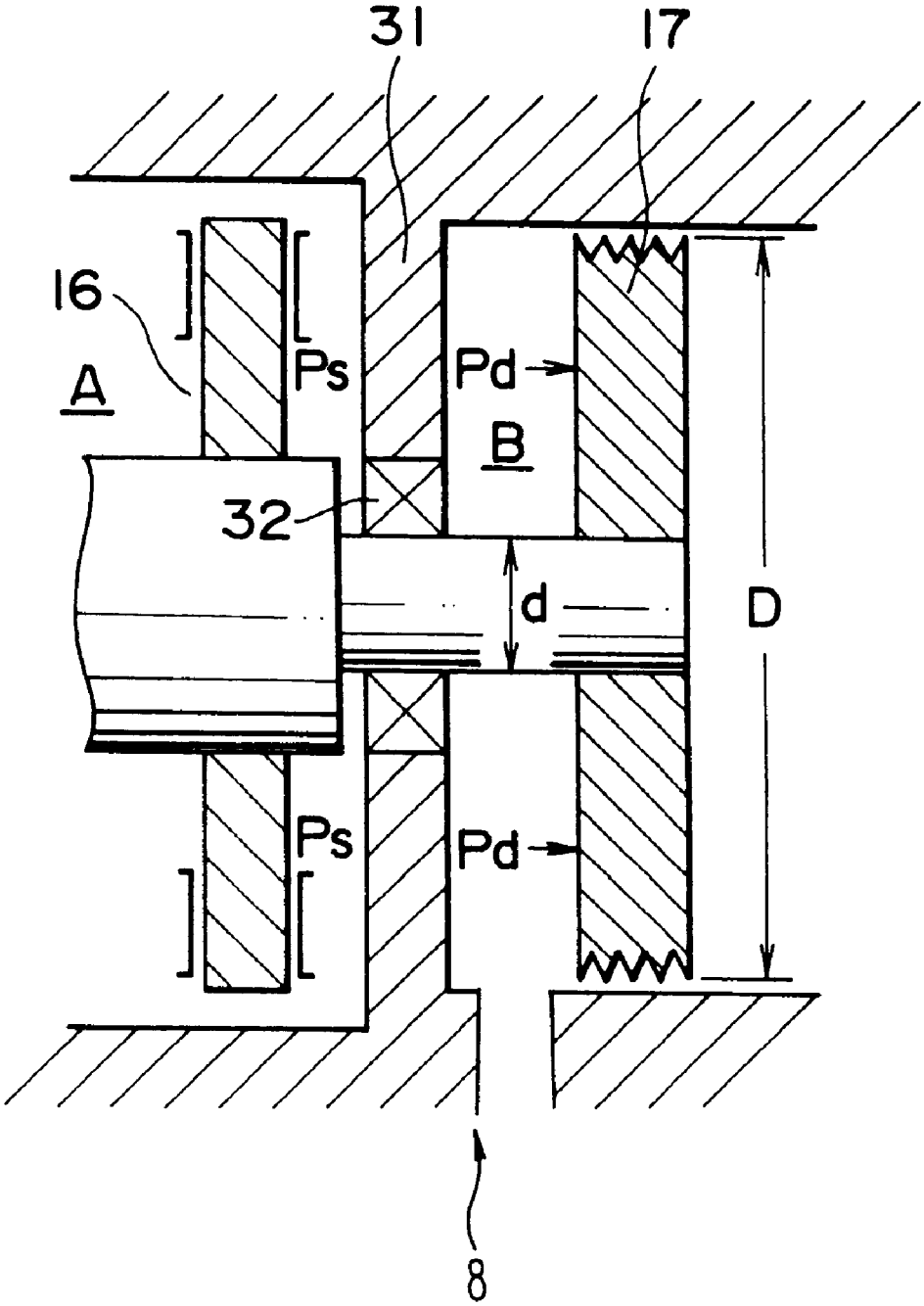
FIG. 3 is a sectional view showing, in an enlarged scale, a thrust bearing and a balance piston of the compressor shown in FIG. 1.
Figure 6:
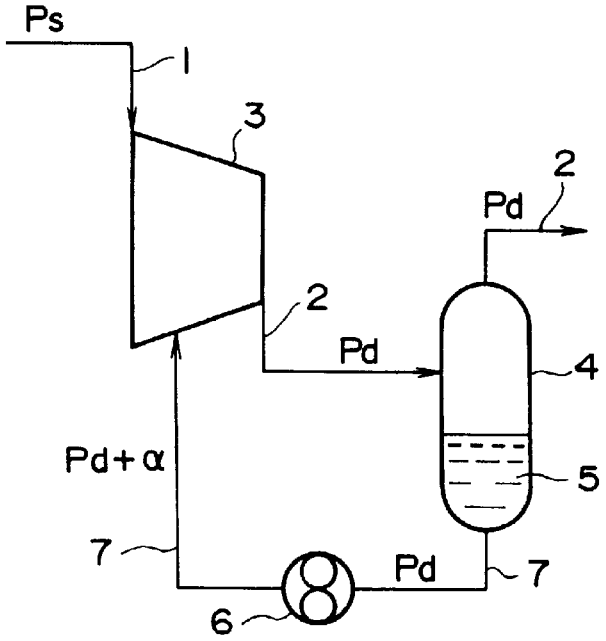
FIG. 6 PRIOR ART
FIG. 6 shows the entire constitution of a conventional screw compressor.
Figure 7:
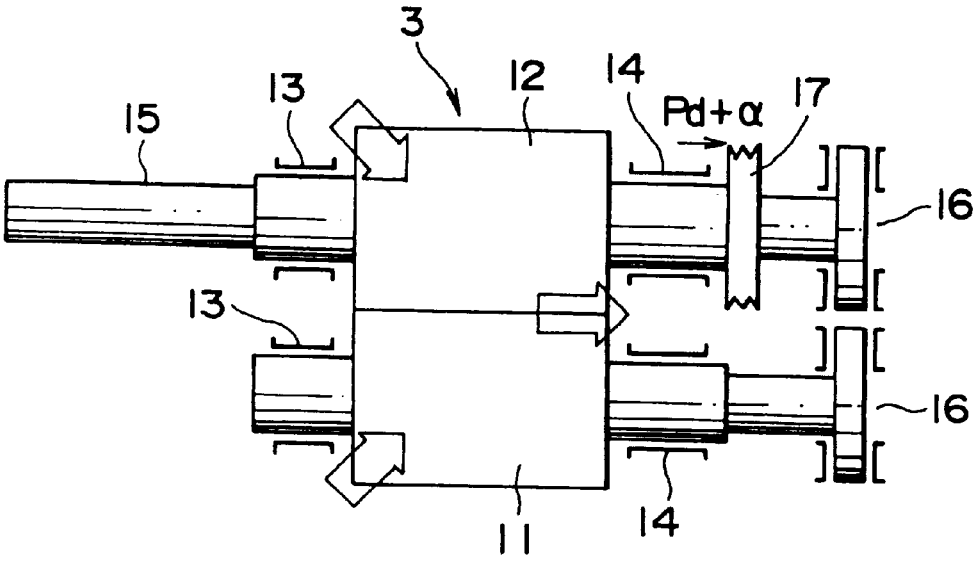
FIG. 7 PRIOR ART
FIG. 7 shows the internal construction of the compressor shown in FIG. 6.
Figure 9:
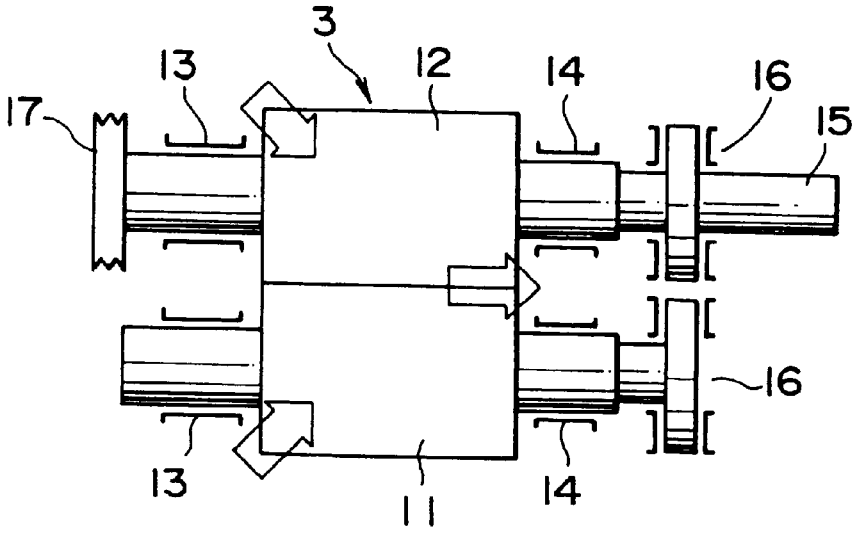
FIG. 9 PRIOR ART
FIG. 9 shows the entire constitution of a conventional screw compressor of another type.
Figure 8:
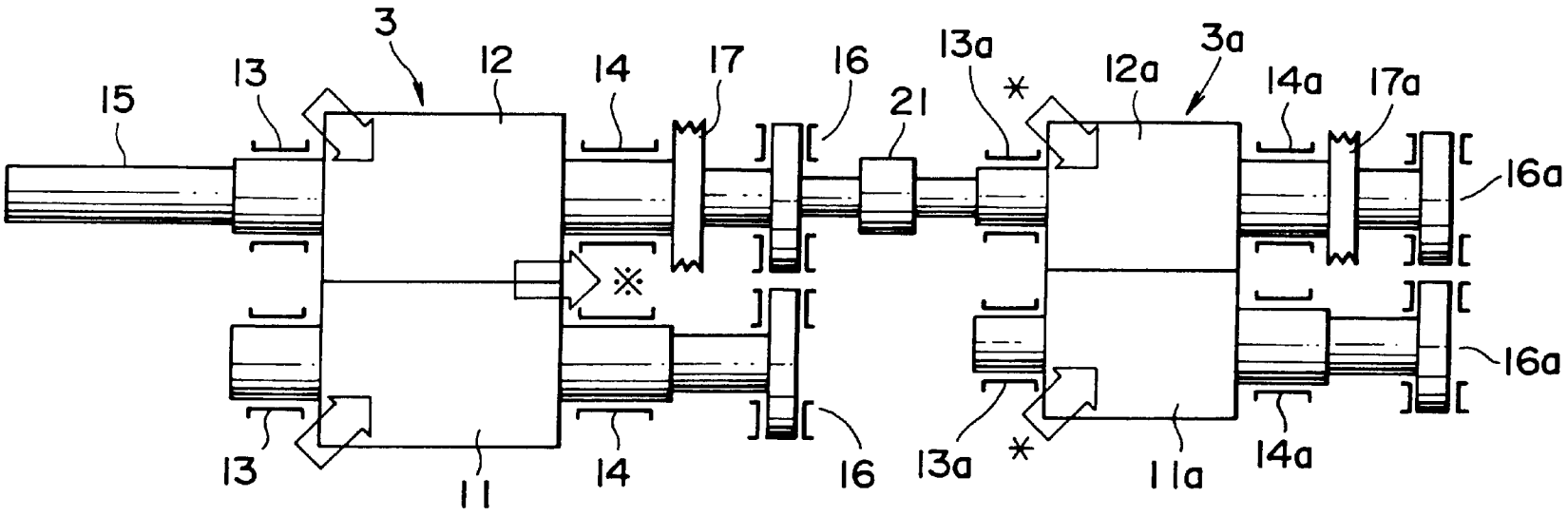
FIG. 8 PRIOR ART
FIG. 8 shows the internal construction of the conventional screw compressor in which the construction similar to a compressor body shown in FIG. 6 is coupled in tandem.
Figure 10:
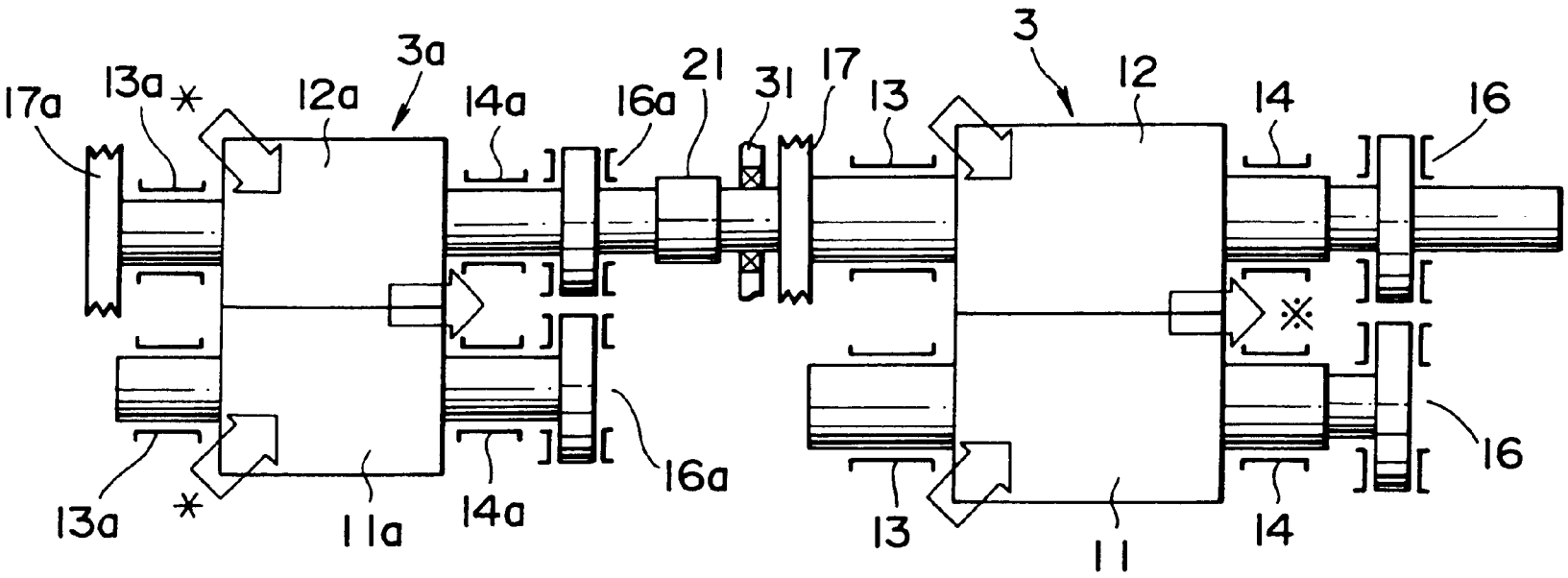
FIG. 10 PRIOR ART
FIG. 10 shows the internal construction of the conventional screw compressor in which the construction similar to a compressor body shown in FIG. 9 is coupled in tandem.

FIGS. 1 to 3 show a screw compressor according to a first embodiment of the first aspect of the invention. Parts common to those of the screw compressor shown in FIGS. 6 and 7 are indicated by the same reference numerals, description of which is omitted.

According to this embodiment, there is provided an equalizing flowpassage 8 branched from an oil flowpassage 7 on the primary side of an oil pump 6. A portion of the oil flowpassage 7 leading to the secondary side of the oil pump 6 is directed radial bearings 13, 14, and the equalizing flowpassage 8 is directed to a balance piston 17. The construction of the interior of the compressor body 3 will be described in further detail.

As shown in FIGS. 2, 3, the radial bearing 14, the thrust bearing 16 and tie balance piston 17 are provided in that order, on the discharge side of the compressor body 3. A partitioning wall 31 is provided between the thrust bearing 16 and the balance piston 17. The partitioning wall 31 is provided, at its inner diameter, with a shaft seal means 32 to cut off the pressure in space A, which houses the thrust bearing 16, from space B, in which the balance piston 17 is housed. Space B is independent of other constituent elements such as the input shaft 15, the thrust bearing 16, the radial bearing 13, 14, and the like.

A suction pressure $P_s$ is directed to the space A, and a discharge pressure $P_d$ is directed by the equalizing flowpassage 8, to a surface of the balance piston 17 on the thrust bearing 16 side of the balance piston 17.

As described above, since the input shaft 15 is arranged on the suction side, the diameter of the thrust bearing portion is not affected by the diameter of the radial bearing 14 and the input shaft 15 but the inside diameter of the thrust bearing 16 can be made small to increase the load capacity thereof. Further, since the space B is independent of other constituent elements, the shaft diameter and outside diameter of the balance piston 17 can be determined without being affected by other constituent elements.

The force F acting on the balance piston 17 is expressed by the following formula:

$$F=(D^2-d^2)\cdot(\pi/4)\times P_d$$

wherein D is the outside diameter of the balance piston 17, and d is the shaft diameter of the balance piston 17. Accordingly, for sufficiently reducing the thrust force, the force F must be made large. In order to maximize force F, $(D^2-d^2)$ must be maximized to secure a pressure receiving area necessary for the balance piston 17. That is, the outside diameter D of the balance piston 17 is made relatively large and the shaft diameter d thereof is made relatively small.

Further, in this compressor, the discharge pressure $P_d$ is applied to the balance piston 17. The force F is therefore proportional to the discharge pressure. In the case where the force acting on the screw rotors 11, 12 in the direction from the discharge side toward the suction side is small, as at the time of no load operation immediately after the start of the compressor, the force F is also small, and therefore no reverse thrust load is generated to prevent contact between the screw rotors 11, 12 and the wall portion of the rotor chamber.

Figure 4:
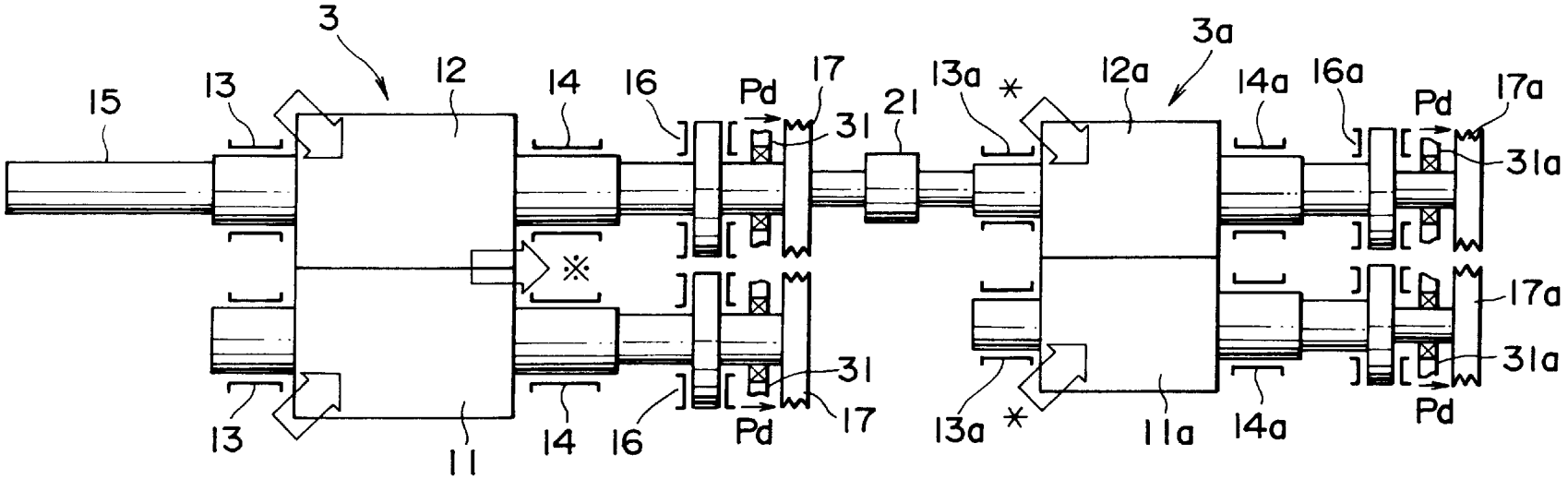
FIG. 4 shows the internal construction of a screw compressor according to a second embodiment of the first aspect of the invention.

FIG. 4 shows the oil injected screw compressor according to a second embodiment of the first aspect of the invention. This oil injected screw compressor basically comprises the same construction as the compressor body 3 shown in FIGS. 1 to 3 which is coupled in tandem by a coupling 21 except that the oil injected screw compressor shown in FIGS. 1 to 3 is of the single stage whereas that shown in FIG. 4 is of the two-stage. Accordingly, parts of the oil injected screw compressor shown in FIG. 4 corresponding to those of the oil injected screw compressor shown in FIGS. 1 to 3 are indicated by the same reference numerals. Particularly, a subscript a is attached to the parts in FIG. 4 which correspond to the same parts in FIGS. 1 to 3, which is omitted.

Compressed gas discharged from the first-stage compressor body 3 flows from a portion marked by z,900 to a portion marked by *, is compressed by the second-stage compressor 3*a*, and is discharged to the discharge flowpassage 2. Also in this compressor, oil with pressure $P_d$ acts on the surface of the balance pistons 17, 17*a* facing radial bearing 14, 14*a*.

Similarly to the compressor shown in FIGS. 1 to 3, the compressor shown in FIG. 4 can employ the thrust bearings 16, 16*a* which have a large load capacity, secure a large pressure receiving area of the balance pistons 17, 17*a* and enable the prevention of the aforementioned contact. In addition, such a compressor, provides a construction in which the discharge port of the first-stage compressor body 3 can be easily communicated with the suction port of the second-stage compressor body 3*a* by an internal flowpassage formed within the casing without depending on an external pipe. The employment of the internal flowpassage makes the construction of the compressor simple and compact, and reduces vibrations and noises.

Figure 5:
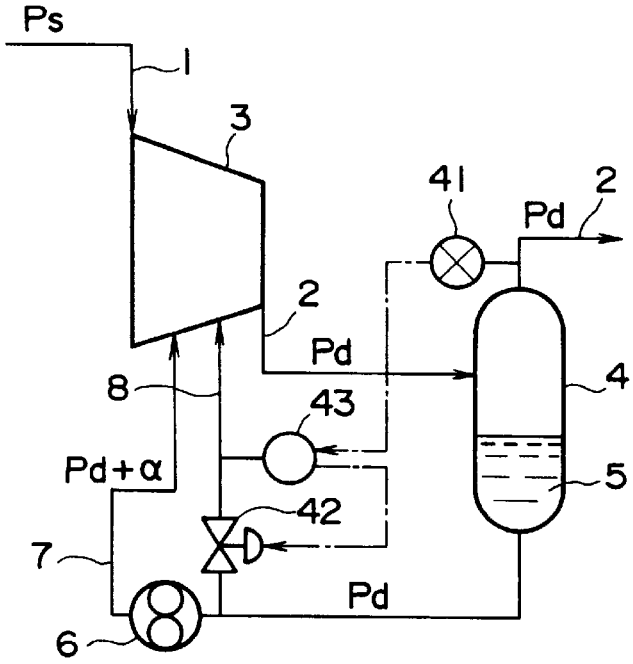
FIG. 5 shows the entire constitution of a screw compressor according to a second aspect of the invention.

FIG. 5 shows a screw compressor according to a second aspect of the invention. Parts common to those of the screw compressor shown in FIG. 1 are indicated by the same reference numerals, description of which is omitted.

In this compressor, a pressure detector 41 capable of detecting pressure is provided in the discharge flowpassage 2. The equalizing flowpassage 8 is provided with a pressure regulating valve 42 and a pressure regulating meter 43 for detecting pressure of the equalizing flowpassage 8 and receiving a pressure signal indicative of detected pressure from the pressure detector 41. Arranged as such, meter 43 adjusts an opening degree of the pressure regulating valve 42 so that a difference between pressure of the discharge flowpassage and pressure of the equalizing flowpassage is maintained within a predetermined range.

With the constitution as described above, it is possible to regulate pressure acting on the balance piston 17, prevent occurrence of the reverse thrust load, maintain the force acting on the thrust bearing 16 in an optimum condition, and operate the compressor in a stable manner.

While the compressor shown in FIG. 5 is a single-stage compressor, it is to be noted, of course, that the above arrangement of pressure detector 41, the pressure regulating valve 42 and the pressure regulating meter 43 can be also applied to the two-stage type of compressor. Therefore, according to the first aspect of the invention, oil is separated and recovered from compressed gas discharged together with oil and stored in the lower oil reservoir. An oil separating and recovering unit for delivering the compressed gas with oil separated is provided in the discharge flowpassage. A rotor shaft extending from both sides of a screw rotor is rotatably supported by radial bearings to allow the input shaft to serve as a rotor shaft, wherein the rotor shaft on the discharge side is rotatably supported by the thrust bearing at a position farther away from the screw rotor than the radial bearings. A balance piston is mounted on the rotor shaft at a position farther away from the screw rotor than the thrust bearing. A partitioning wall for cutting off pressure is provided between the thrust bearing and the balance piston. Finally, an equalizing flowpassage for directing oil in the oil reservoir to the space between the partitioning wall and the balance piston, without being pressurized, is provided.

Therefore, by including a balance piston with a large pressure receiving area, a thrust bearing with a large load capacity, the present invention prevents a reverse thrust load state, while reducing vibrations and noises without sacrificing a simple and compact construction.

According to the second invention, a pressure detector capable of detecting pressure is provided in the discharge flowpassage. An equalizing flowpassage is provided with a pressure regulating valve and a pressure regulating meter for detecting pressure of the equalizing flowpassage and receiving a pressure signal indicative of detected pressure from the pressure detector. Arranged as such, the meter adjusts an opening degree of the pressure regulating valve so that a difference between pressure of the discharge flowpassage and pressure of the equalizing flowpassage is maintained within a predetermined range.

Therefore, the present invention benefits from a regulated pressure acting on the balance piston, the absence of a reverse thrust load, an optimized force acting on the thrust bearing and a stable compressor.

What is claimed is:

1. An oil injected compressor, comprising:

a compressor body;

a screw rotor within said compressor body;

a rotor shaft extending from both sides of said screw rotor, the input side of said rotor shaft being arranged on a suction side of said screw rotor;

at least a first and a second radial bearing for rotatably supporting said rotor shaft on the suction side and a discharge side;

a thrust bearing for rotatably supporting said rotor shaft on the discharge side of said rotor shaft and at a position farther away from said screw rotor than said radial bearing;

a balance piston mounted on said rotor shaft at a position farther away from said screw rotor than said thrust bearing;

a partitioning wall positioned between said thrust bearing and said balance piston and fixed in said compressor body against axial movement so as to cut off pressure communication between said thrust bearing and said balance piston;

a discharge flowpassage for compressed gas;

an oil separating and recovering unit provided in said discharge flowpassage; and an equalizing flowpassage for directing oil from an oil reservoir of said oil separating and recovering unit to a space in communication with said partitioning wall and said balance piston, wherein the oil directed through said equalizing flowpassage is not further pressurized by an oil pump.

2. The oil injected compressor according to claim 1, further comprising:

a first pressure detector provided in said discharge flowpassage;

a second pressure detector provided in said equalizing flowpassage;

a pressure regulating valve provided in said equalizing flowpassage; and a pressure regulating meter for adjusting an opening degree of said pressure regulating valve for maintaining, within a predetermined range, a difference between a pressure value detected by said first pressure detector and a pressure value detected by said second pressure detector;

wherein said first and second pressure detector are connected to said pressure regulating meter so as to provide detected pressures to said pressure regulating meter.

* * * * *